US006252473B1

(12) United States Patent
Ando

(10) Patent No.: US 6,252,473 B1
(45) Date of Patent: Jun. 26, 2001

(54) POLYHEDRAL-SHAPED REDUNDANT COAXIAL SWITCH

(75) Inventor: Michael N. Ando, Torrance, CA (US)

(73) Assignee: Hughes Electronics Corporation, El Segundo, CA (US)

( * ) Notice: Subject to any disclaimer, the term of this patent is extended or adjusted under 35 U.S.C. 154(b) by 0 days.

(21) Appl. No.: 09/225,956

(22) Filed: Jan. 6, 1999

(51) Int. Cl.[7] ..... H01P 1/12

(52) U.S. Cl. ..... 333/105; 200/504; 333/108; 335/5

(58) Field of Search ..... 333/105, 108; 200/51.05, 51.06, 504; 335/4, 5

(56) References Cited

U.S. PATENT DOCUMENTS 3,260,967 * 7/1966 McClaflin et al. ..... 333/105
3,270,299 * 8/1966 Stapf ..... 333/105
4,070,637 * 1/1978 Assal et al. ..... 333/105
5,724,014 * 3/1998 Leikus et al. ..... 333/105 X
5,936,482 * 8/1999 Ando et al. ..... 333/108

* cited by examiner

*Primary Examiner*—Paul Gensler
(74) *Attorney, Agent, or Firm*—T. Gudmestad

(57) ABSTRACT

A three dimensional microwave switch having a plurality of waveguide transmission lines configured in an octahedral shape having microwave I/O ports at the corners. Individual actuators selectively move respective reeds within the waveguide transmission lines between a signal-attenuating position abutting the interior surface of the waveguide transmission line and a signal-conducting position substantially coaxial with the waveguide transmission line and abutting the signal lines of the I/O microwave ports couple to opposite ends of the waveguide transmission line.

10 Claims, 4 Drawing Sheets

POLYHEDRAL-SHAPED REDUNDANT COAXIAL SWITCH

CROSS-REFERENCE TO RELATED APPLICATIONS

This application is related to U.S. patent application Ser. No. 08/974,932, entitled "Three Dimensional Microwave Switches" filed on Nov. 20, 1997, now Pat. No. 5,936,482 the subject matter of such patent being incorporated herein by reference.

TECHNICAL FIELD

The present invention relates to microwave switches, and more particularly to three-dimensional (3D) microwave switches, specifically octahedral-shaped switches, for routing microwave signals along selectable signal paths among a plurality of switch ports.

BACKGROUND ART

Microwave switches are used in redundant switching networks on spacecrafts to route M input signals to M outputs through N failure-prone devices, such as traveling wave tube amplifiers (TWTAS). This is accomplished using two layers of microwave switches, with each layer including M serial connected 4-port switches, for example, T-switches. The switches in the input layer are controlled to route the M input signals around the failed devices and through functioning devices. The switches in the output layer are controlled to route the signals produced by the M selected devices to the M outputs.

Typically, planar T-switch configurations are used effectively in redundant switching networks on board spacecraft. However, there are a number of drawbacks associated with the prior art switches. A typical spacecraft employs several hundred microwave switches so that a small reduction in the weight of each switch can result in significant cost savings.

The actuators are the primary weight components of the switches, and therefore a switch configuration having a simpler and lighter weight actuator is desirable. Further in a planar T-switch, the three inner and outer waveguides necessarily have different lengths. As a result, the signal paths through different ports have different microwave properties, which prohibits the overall system from being optimized. In addition, the ends of the center conductors are flared substantially to ensure contact to the underlying conductive reeds in the actuators. This limits the high frequency performance of the switch. Also in a planar T-switch, the physical access to the coaxial connector is limited. Finally, as the complexity of the redundant switching networks increases, it may be difficult to develop planar microwave switches with enough ports to reroute the signals.

The prior art encompasses a dual T-switch assembly that consists of two T-switches with a coaxial cable running between them. When connected together, a signal going into one switch can be passed through intermediate switches to any output. To accomplish this the assembly requires twelve signal paths, eight connectors and a coax cable. This configuration adds unnecessary weight and complexity to the switch assembly. The complexity of the system also results in diminished RF performance.

Pat. No. 5,936,482 provides a lighter weight three dimensional microwave switch that has improved uniformity between signal paths, high frequency performance and physical access. The switch configures the waveguide transmission lines in three dimensions to define a polyhedron and positions the I/O microwave ports at the corners of the polyhedron. An actuator selectively moves respective reeds in the waveguide transmission lines between a signal-attenuating position abutting the interior surface of the waveguide transmission line and a signal-conducting position substantially coaxial with the waveguide transmission line and abutting the signal lines of the I/O microwave ports coupled to opposite ends of the waveguide transmission line.

The three dimensional switch may have an octahedral cavity providing six (6) connectors and twelve (12) paths. Although the octahedral configuration requires an independent actuator for each path, it retains the microwave performance advantages of identical path lengths and configuration while reducing weight and simplifying the microwave path.

The three-dimensional switch proposed in Pat. No. 5,936,482 is lighter in weight and more reliable in performance than prior art microwave planar switches. However, it still has a complex interconnection arrangement that requires coax cables to connect switches. In addition, the three-dimensional switch has somewhat limited signal path flexibility.

There is an ever present need for reduced weight in spacecraft applications and improved RF performance. There is also a need for simplified switch interconnection methods and increased signal path flexibility over the prior art.

SUMMARY OF THE INVENTION

The present invention provides a three-dimensional microwave switch for routing signals in an operating frequency band along selectable signal paths, and particularly for routing signals around failed devices in redundant switching networks on board spacecraft. The microwave switch of the present invention is particularly useful for interconnecting switches. It has reduced weight, simplified interconnection requirements, improved RF performance and improved signal path flexibility in comparison to prior art switch assemblies.

The RF microwave coaxial switching device of the present invention is based on the three dimensional octahedral switch disclosed in Pat. No. 5,936,482, the disclosure of which is hereby incorporated by reference herein. That switch has six connectors and twelve transmission lines. In contrast, the three-dimensional switch of the present invention has six connectors and thirteen transmission lines arranged in an octahedral shape. The thirteenth transmission line is a through path between two opposing connectors and passes through the interior of the switch cavity. This additional transmission line allows one three dimensional switch of the present invention to replace two switches that are required in prior art dual T-switch assemblies.

The switch of the present invention encompasses all usable prior art dual T-switch states and has several additional states that are not obtainable with the prior art dual T-switch arrangement. Typically, the transmission lines and ports are formed as part of a one-piece conducting cavity, but they may also be connected in a skeletal configuration.

The three-dimensional microwave switch topology facilitates the use of simpler actuating mechanisms than are used in planar microwave switches, making them lighter weight than their planar counterparts. In addition, the conductive reeds contact the port's signal line around its circumference rather than at its end, thereby allowing the signal line to have less flare and better high frequency performance. The physical access to the switch is also improved by locating the connectors at the corners of the three-dimensional shape of the switch. The three-dimensional topology incorporates an octahedral-shaped cavity for the switch. The switch also has six ports, which are useful in more complex redundant switching networks.

It is an object of the present invention to reduce the weight of redundant microwave switches.

It is another object of the present invention to improve the RF performance of redundant microwave switches.

It is yet another object of the present invention to improve performance over prior art dual T-switch assemblies, while reducing the number of intermediate paths a signal must pass through.

It is still another object of the present invention to increase signal path flexibility.

Other objects and features of the present invention will become apparent when viewed in light of the detailed description of the preferred embodiment when taken in conjunction with the attached drawings and appended claims.

BEST MODES FOR CARRYING OUT THE INVENTION

Figure 1:
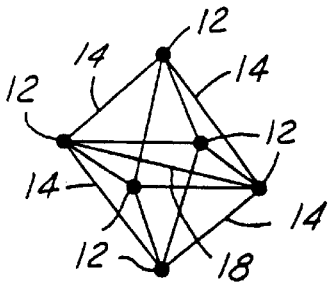
FIG. 1 is an isometric view of an octahedral three-dimensional switch of the present invention.

FIG. 1 is an isometric schematic of the microwave switch 10 of the present invention. The microwave switch has six ports 12 interconnected in an octahedral configuration by thirteen waveguide transmission lines 14. Twelve of the transmission lines 14 lie along the vertices of the octahedral shape. The thirteenth transmission line is a through path 18 passing through the interior of the octahedral shape and located between one pair of opposing ports 12. Each port 12 abuts up to four of the waveguide transmission lines 14, and two opposing ports may abut the through path transmission line 18.

The waveguide transmission lines 14 are interconnected in an octahedral configuration with the six ports 12 positioned at the corners of the octahedron. The waveguide transmission lines 14 are dimensioned to have a cutoff frequency, suitably 45 GHz, greater than the operating frequency band.

Figure 1A:
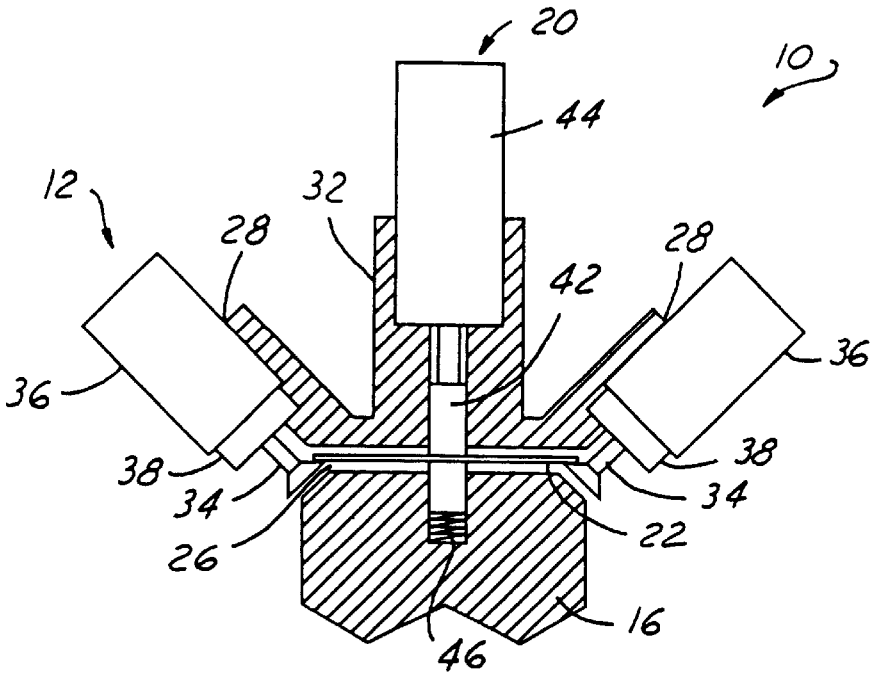
FIG. 1A is a partial cross-sectional view of an octahedral three-dimensional switch of the present invention in the signal-conducting position.
Figure 1B:
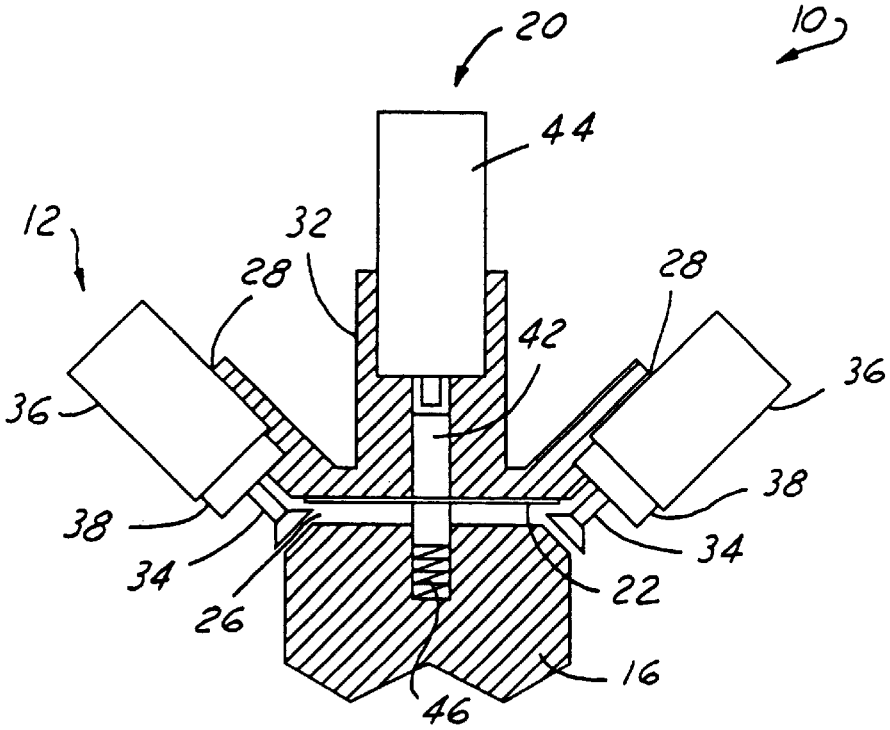
FIG. 1B is a partial cross-sectional view of an octahedral three-dimensional switch of the present invention in the signal-attenuating position.

FIG. 1A is a partial view of the switch 10 of the present invention in the signal-conducting position. FIG. 1B is a partial view of the switch 10 in the signal-attenuating position. The switch 10 may have the transmission lines and ports formed as part of a one-piece conductive cavity 16. Alternatively, they may be connected in a skeletal configuration (not shown). An actuator 20 selectively moves conductive reeds 22 inside the transmission lines between a signal-attenuating position and a signal-conducting position.

The waveguide transmission lines 14 and ports 12 are formed in an octahedral-shaped conductive cavity 16 as best shown in FIGS. 1A and 1B. The cavity 16 is machined to define grooves 26 along its respective edges, six coaxial connectors 28 in its corners, and a through path 18 (shown in FIG. 1) passing through its interior. Referring now to FIGS. 1A and 1B a conductive member 32 is fastened to each groove 26 and the through path to define the waveguide transmission line 14 around the reed 22. The conductive member 32 provides the interior surface against which the reed 22 is held in the signal attenuating position (see FIG. 1B).

The connector 28 is a coaxial connector and is inserted into each port 12 with its center conductor 34 extending into the cavity 16 and its outer shield 36 grounded to the cavity 16 to form the I/O port 12. The center conductor 34 and outer shield 36 are separated by an insulative layer 38 and together define a signal line for the port 12.

A plurality of independent actuators 20 selectively move the reeds 22 between signal-attenuating and signal-conducting positions. In the signal-attenuating position (see FIG. 1B) the reeds 22 abut the interior surface of their respective waveguide transmission line 14. In the signal-conducting position (see FIG. 1A), the reeds 22 are substantially coaxial with their respective waveguide transmission line 14 and abut the center conductor 34 of the coaxial connector 28 at opposite ends of the waveguide transmission line 14.

Each actuator 20 suitably includes a dielectric stub 42 that is carried by each reed 22 at its mid-point and extends perpendicular to the reed on both sides. A latching solenoid 44 exerts a force on the stub 42 that moves the reed 22 such that when the solenoid 44 is deactivated a return spring 46 forces the reed 22 to its signal-attenuating position as shown in FIG. 1B.

Referring again to FIG. 1, the additional through path 18 provides simplified interconnection by reducing the number of coax cable connections required to obtain more input and output ports. A single switch 10 of the present invention can be used to replace two prior art switches interconnected by a coax cable. The switch of the present invention provides more signal path flexibility than two prior art switches combined since the switch of the present invention has individual actuators for the reeds. The following examples comparing prior art switches 100 and switches 10 of the present invention demonstrate the simplified interconnection methods and the enhanced signal path flexibility of the three-dimensional switch 10.

Figure 2:
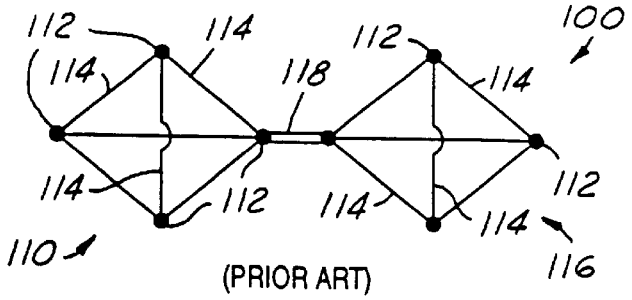
(PRIOR ART) FIG. 2
FIG. 2 is a planar schematic of a prior art dual T-switch assembly.

A prior art dual switch assembly 100 is shown in planar form in FIG. 2. The prior art switch 100 requires a first T-switch 110 having four connectors 112, and six transmission lines 114, and a second T-switch 116 having four connectors 112 and six transmission lines 114. A coax cable 118 interconnects the first and second T-switches, 110 and 116. The result is a total of eight connectors 112, twelve transmission lines 114, and a coax cable 118. Two of the eight connectors 112 are used to interconnect the switches 110 and 116. The other six connectors 112 are utilized as inputs and outputs.

Figure 3:
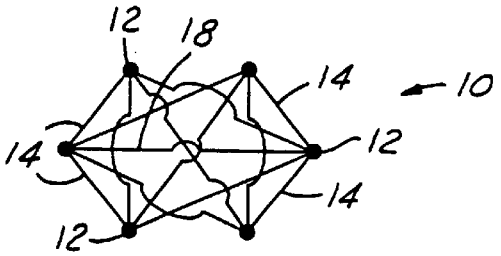
FIG. 3 is a planar schematic of the present invention at least equivalent to the prior art T-switch assembly.

In comparison, FIG. 3 demonstrates a single three-dimensional switch of the present invention that has six connectors, thirteen transmission lines, and no coax cable. The same number of usable connectors is achieved using only one switch of the present invention as opposed to the two switches required in the prior art assembly. This provides a significant reduction in weight. RF performance is improved using switch 10 of the present invention because the signal travels through only two connectors and one reed as opposed to up to four connectors and a coax cable. Also, thirteen transmission lines, as opposed to only twelve in the prior art, provide more signal path flexibility.

Figure 4:
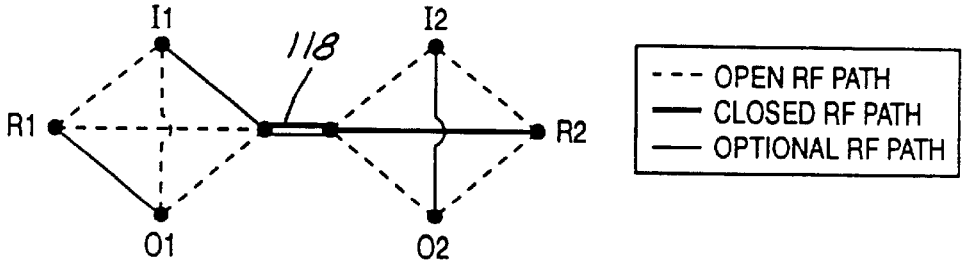
(PRIOR ART) FIG. 4
FIG. 4 is a planar schematic of a prior art dual T-switch assembly.

FIG. 4 is a schematic of a prior art dual T-switch assembly in which the ports are generally categorized as Input 1 (I1), Input 2 (I2), Output 1 (O1), Output 2 (O2), Redundant 1 (R1) and Redundant 2 (R2). It should be noted that while the connectors are labeled as listed above, it is for example purposes only to reflect typical usage of the T-switch configuration. Any port may be used as an input, output or redundant port at any time. The interconnection paths of the prior art switches 100 are limited to nine states as shown in the following table.

DUAL T-SWITCH ASSEMBLY (PRIOR ART)

| STATE | INPUT 1 to | INPUT 2 to | REDUNDANT PATH |
|---|---|---|---|
| 1 | OUTPUT 1 | OUTPUT 2 | R1–R2 |
| 2 | OUTPUT 1 | R1 | R2–OUTPUT 2 |
| 3 | OUTPUT 1 | R2 | R1–OUTPUT 2 |
| 4 | R1 | OUTPUT 2 | R2–OUTPUT 1 |
| 5 | R1 | OUTPUT 1 | R2–OUTPUT 2 |
| 6 | R1 | R2 | (OUTPUT 1–OUTPUT 2*) |
| 7 | R2 | OUTPUT 2 | R1–OUTPUT 1 |
| 8 | (INPUT 2*) | (INPUT 1*) | R1–OUTPUT 1<br>R2–OUTPUT 2 |
| 9 | OUTPUT 2 | R2 | R1–OUTPUT 1 |

*Note:
states involving input 1 to input 2 or output 1 to output 2 are unusable.

Figure 5:
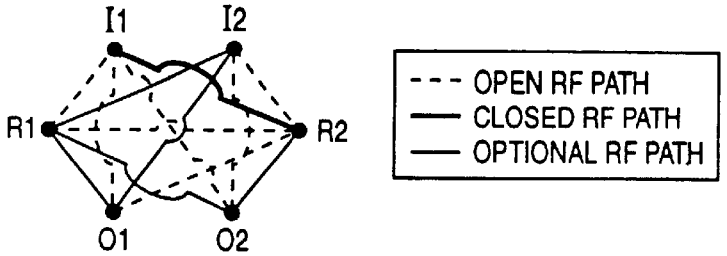
FIG. 5 is a planar schematic of a comparable circuit to FIG. 4 using only one three-dimensional switch of the present invention.

FIG. 5 is a schematic of a single switch 10 of the present invention. The six ports can be categorized, or labeled, as Output 1 (O1), Output 2 (O2), Input 1 (I), Input 2 (I2), Redundant 1 (R1) and Redundant 2 (R2). It should be noted that while the connectors are labeled as listed above, it is for example purposes only to reflect typical usage of the T-switch configuration. Any port may be used as an input, output or redundant port at any time. The interconnection paths for the switch 10 of the present invention include thirteen states as shown in the following table. The first nine (9) states are identical to the dual T-switch assembly. However, the dual T-switch assembly of the prior art cannot achieve states ten through thirteen of the present invention.

PRESENT INVENTION

| STATE | INPUT 1 to | INPUT 2 to | REDUNDANT PATH |
|---|---|---|---|
| 1 | OUTPUT 1 | OUTPUT 2 | R1–R2 |
| 2 | OUTPUT 1 | R1 | R2–OUTPUT 2 |
| 3 | OUTPUT 1 | R2 | R1–OUTPUT 2 |
| 4 | R1 | OUTPUT 2 | R2–OUTPUT 1 |
| 5 | R1 | OUTPUT 1 | R2–OUTPUT 2 |
| 6 | R1 | R2 | (none) |
| 7 | R2 | OUTPUT 2 | R1–OUTPUT 1 |
| 8 | (none) | (none) | R1–OUTPUT 1<br>R2–OUTPUT 2 |
| 9 | OUTPUT 2 | R2 | R1–OUTPUT 1 |
| 10 | R2 | OUTPUT 1 | R1–OUTPUT 2 |
| 11 | R2 | R1 | (none) |
| 12 | OUTPUT 2 | OUTPUT 1 | R1–R2 |
| 13 | OUTPUT 2 | R1 | R2–OUTPUT 1 |

The connection between Input 1 (I1) and Redundant 2 (R2) is highlighted in FIG. 4 to demonstrate the path that the RF signal must travel between these two ports. In the prior art switch assembly, the signal must travel through four connectors, two reeds and one coaxial cable. This is the only path available between these two ports. Also, because of the reed and actuator configuration of the prior art switches, Input 2 must connect to Output 2.

FIG. 5 highlights the same connection between Input 1 (I1) and Redundant 2 (R2) as shown in FIG. 4, but using a single switch 10 of the present invention. In the equivalent connection, the present invention has reduced the signal travel to only two connectors and one reed. Additionally, because of the independent actuators for each reed, optional transmission paths are possible. It should be noted that Input 2 can be connected to Redundant 1, Output 1 or Output 2 where the prior art assembly limits the connection of Input 2 to Output 2 only.

Figure 6:
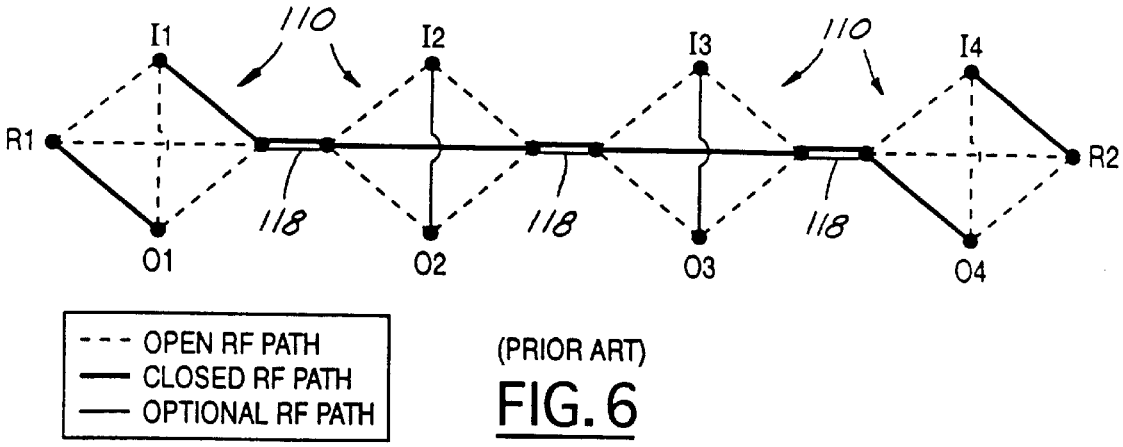
(PRIOR ART) FIG. 6
FIG. 6 is an example of a prior art T-switch assembly consisting of four switches.

The difference is even more dramatic when comparing a prior art T-switch assembly that uses four T-switches as opposed to an equivalent assembly that uses only two switches of the present invention. The prior art assembly is shown in FIG. 6. There are four prior art T-switches 110 connected to each other by three coax cables 118. The connectors are designated as Input 1 (I1), Input 2 (I2), Input 3 (I3), Input 4 (I4), Output 1 (O1), Output 2 (O2), Output 4 (O4), Redundant 1 (R1) and Redundant 2 R2). It should be noted that while the connectors are labeled as listed above, it is for example purposes only to reflect typical usage of the T-switch configuration. Any port may be used as an input, output or redundant port at any time. When connecting Input 1 to Output 4, the signal path includes four reeds, eight connectors and three coax cables. Also, it is only possible to connect Redundant 1 to Output 1. Input 2 can connect only to Output 2. Input 3 can connect only Output 3. And Input 4 can connect only to Redundant 2. This is one example of the limited flexibility of the prior art switch assembly.

Figure 7:
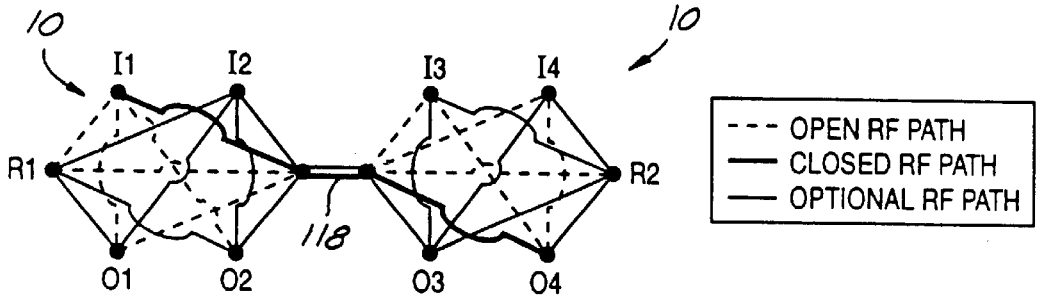
FIG. 7 is a comparable assembly to FIG. 6 using only two three-dimensional switches of the present invention.

An equivalent circuit, using only two switches 10 of the present invention and one coax cable 118, is shown in FIG. 7. When connecting Input 1 to Output 4, the signal path is reduced to two reeds, four connectors and one coax cable. This is a significant improvement in weight reduction and RF performance over the prior art. The flexibility of the present invention is greatly enhanced by the individual actuators providing many optional paths. For example, Redundant 1 may connect to Output 1, Output 2 or Input 2. Input 2 may connect to Redundant 1, Output 1, or Output 2. Input 3 may connect to Output 3 or Redundant 2. Input 4 may connect to Output 3 or Redundant 2. And Redundant 2 may connect to Input 3, Input 4 or Output 3. Most or these connections are not possible in the prior art T-switch assembly.

Figure 8:
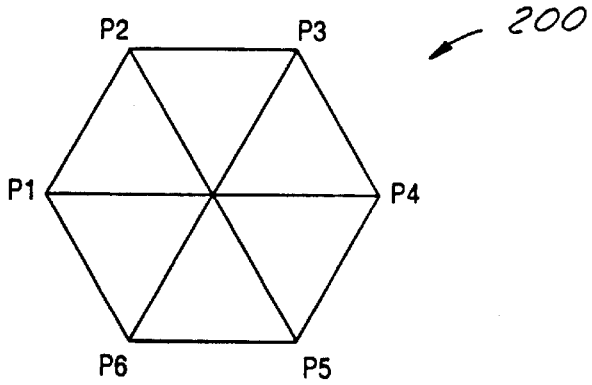
(PRIOR ART) FIG. 8
FIG. 8 is a planar configuration of a prior art M-switch.
Figure 9:
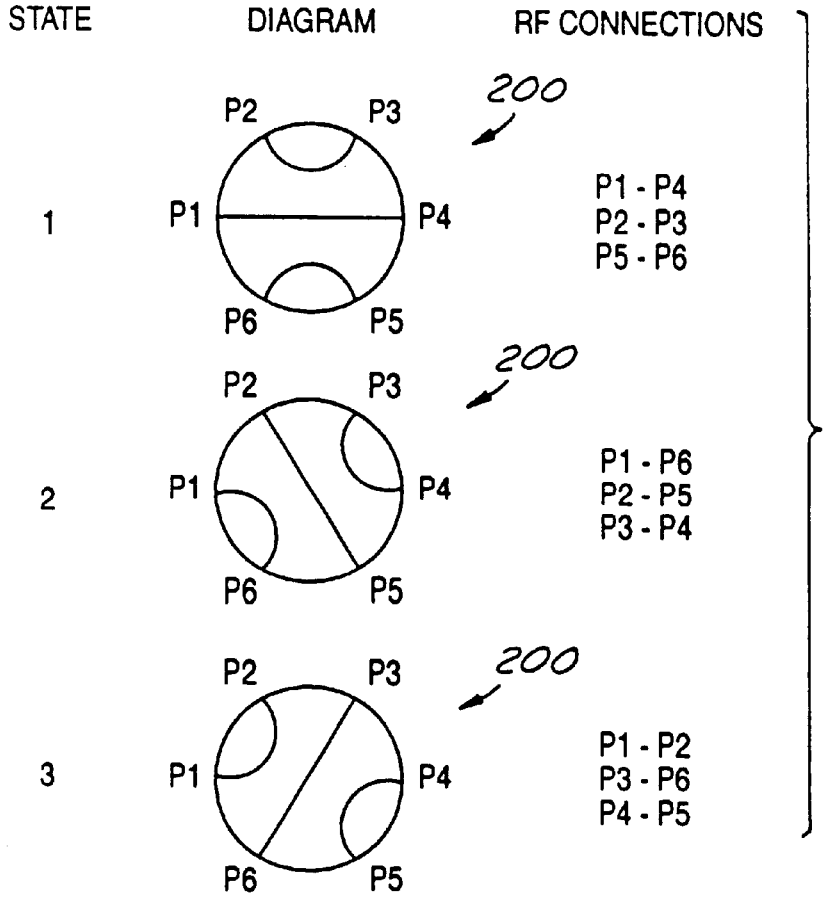
(PRIOR ART) FIG. 9
FIG. 9 is a table reflecting the possible states of a prior art M-switch.

It is also possible to use the switch 10 of the present invention as a substitute for an M-switch. In FIG. 8, there is shown a prior art M-switch 200 in a planar configuration showing all possible paths, P1 through P6, for the switch. FIG. 9 shows the prior art M-Switch 200 in each of three possible states and the RF connections that are possible for each state.

Figure 10:
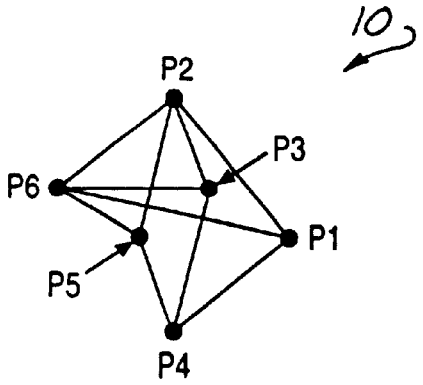
FIG. 10 is an isometric schematic of the switch of the present invention relabeled to identify similarity with an M-switch configuration.

FIG. 10 is an isometric schematic of the switch 10 of the present invention with the ports relabeled to identify similarity with an M-switch configuration. The ports are labelled P1 through P6. All of the possible paths of the switch 10 of the present invention are not utilized when replacing a prior art M-switch. It should be noted that it is not necessary to utilize all of the possible paths of the switch 10 of the present invention in order for the switch 10 to be effective as an M-switch replacement.

Figure 11:
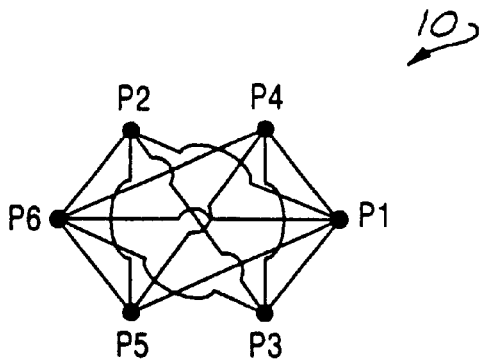
FIG. 11 is a planar schematic of a switch of the present invention showing all of the paths relevant to an M-switch.

FIG. 11 is a planar schematic of the switch 10 of the present invention showing all of the paths relevant to an M-switch and in comparison to the possible paths shown in each of the three states of the M-switch 200 of FIG. 9.

The three-dimensional microwave switch of the present invention provides a significant weight reduction over the prior art by reducing the number of switches required in a switch assembly. The switch of the present invention reduces the number of intermediate paths a signal must travel over which ultimately provides improved RF performance. Independent actuation of the reeds in the switch of the present invention increases signal path flexibility.

While particular embodiments of the invention have been shown and described, numerous variations and alternate embodiments will occur to those skilled in the art. Accordingly, it is intended that the invention be limited only in terms of the appended claims.

What is claimed is:

1. A three dimensional microwave switch for routing signals in an operating frequency band along selectable signal paths between a plurality of switch ports, said switch comprising:

a plurality of I/O microwave ports having respective signal lines;

a plurality of waveguide transmission lines coupled between respective pairs of said I/O microwave ports, each said waveguide transmission line having an interior surface and being dimensioned to have a cutoff frequency greater than said operating frequency band, said waveguide transmission lines being spatially configured in three dimensions to define a polyhedron with said I/O microwave ports positioned at the corners of said polyhedron;

a through path coupled between at least two opposing I/O microwave ports and passing through the interior of said polyhedron;

a plurality of conductive reeds, each said reed being positioned in a respective waveguide transmission line of said plurality of waveguide transmission lines; and an actuator that selectively moves each said reed between a signal-attenuating position abutting said interior surface of said waveguide transmission line and a signal-conducting position substantially coaxial with said waveguide transmission line and abutting said signal lines of said I/O microwave ports coupled to opposite ends of said waveguide transmission line.

2. The microwave switch as claimed in claim 1 wherein said signal lines of said plurality of microwave ports point toward the center of said polyhedron so that they are angled inward at opposite ends of each said waveguide transmission line and away from the interior surfaces, said actuator switching each said reed into said signal-conducting position by moving it toward the center of said polyhedron so that said reed is contacted between the opposing signal lines and moving each said reed into said signal attenuating position by moving it away from the center of said polyhedron against said interior surface.

3. The microwave switch as claimed in claim 2 wherein all of said signal lines have the same angle with respect to all of the reeds they contact, all of said waveguide transmission lines have substantially the same length and cross-section, and all of said reeds have substantially the same length so that the signal paths between any two of said I/O microwave ports have substantially the same microwave properties in said operating frequency band.

4. The microwave switch as claimed in claim 3 wherein said polyhedron has an octahedral shape with thirteen waveguide transmission lines coupled between six coaxial connectors, said actuator comprising a plurality of mechanisms that independently actuate said respective reeds.

5. The microwave switch as claimed in claim 2 wherein said switch further comprises:

a) a one-piece polyhedral-shaped conductive cavity comprising:

i) a plurality of faces;

ii) a plurality of edges, each of said edges having a groove having a pair of open ends; and iii) a plurality of corners, each of said corners having a port for providing access to said open ends of said grooves, said grooves abutting said port;

b) a plurality of conductive members that are fastened to said grooves forming waveguide transmission lines; and c) a plurality of coaxial connectors located in said ports to form I/O microwave ports, each said coaxial connector having a center conductor extending through said port into said open ends of said grooves and an outer conductor coaxially arranged with said center conductor and contacting said cavity to form said signal line.

6. The microwave switch as claimed in claim 5 wherein said one-piece polyhedral-shaped cavity has an octahedral shape with twelve waveguide transmission lines coupled between six coaxial connectors, a through path coupled between two opposing coaxial connectors and passing through the interior of said cavity, said actuator comprising a plurality of mechanisms that independently actuate respective reeds.

7. The switch as claimed in claim 1 wherein said actuator further comprises a different actuating mechanism for each said reed.

8. The microwave switch as claimed in claim 2 wherein said polyhedron has an octahedral shape with twelve transmission lines, a through path, and six ports.

9. A three dimensional microwave switch for routing signals in an operating frequency band along thirteen signal paths between six switch ports, said switch comprising:

a) an octahedral-shaped conductive cavity comprising:

i) eight faces;

ii) twelve edges each having a groove and a pair of open ends; and iii) six corners, each of said corners formed with a coax port for providing access to said open ends of said grooves, said open ends of said grooves abut said coax port;

b) twelve conductive reeds positioned in respective grooves;

c) twelve conductive members fastened to said grooves to define twelve waveguide transmission lines that are coupled between respective pairs of said coaxial connectors, each of said waveguide transmission lines having an interior surface and dimensioned to have a cutoff frequency greater than said operating frequency band;

d) said cavity having a through path extending between opposing coax connectors and passing through the interior of said cavity;

e) a conductive reed positioned in said through path;

f) a conductive member fastened to said through path to define a thirteenth waveguide transmission line; and g) an actuator that selectively moves said reeds a signal-attenuating position abutting the interior surface of their respective waveguide transmission lines and a signal-conducting position substantially coaxial with their respective waveguide transmission lines and contacted between the center conductors of the coaxial connectors that are coupled to opposite ends of their waveguide transmission lines.

10. The switch as claimed in claim 9 wherein said actuator further comprises a different actuating mechanism for each said reed.

* * * * *